United States Patent [19]

Mauser

[11] Patent Number: 4,524,978

[45] Date of Patent: Jun. 25, 1985

[54] SIMULATED STRUCTURAL GASKET

[75] Inventor: Richard J. Mauser, Stow, Ohio

[73] Assignee: Ampat/Midwest Corp., Cleveland, Ohio

[21] Appl. No.: 528,082

[22] Filed: Aug. 31, 1983

[51] Int. Cl.[3] ..... E04C 2/00

[52] U.S. Cl. ..... 277/189; 52/824; 49/DIG. 2

[58] Field of Search ..... 52/397, 717, 718, 821, 52/822, 823, 824; 49/DIG. 2, DIG. 3

[56] References Cited

U.S. PATENT DOCUMENTS

| | | | |
|---|---|---|---|
| 3,359,022 | 12/1967 | Russell | 52/823 |
| 3,995,405 | 12/1976 | Peterson | 52/824 |
| 4,227,704 | 10/1980 | Blaha | 277/189 |
| 4,261,583 | 4/1981 | de Vries | 277/189 |
| 4,386,482 | 6/1983 | Quinif | 52/822 |

*Primary Examiner*—Robert I. Smith

*Attorney, Agent, or Firm*—Alan H. Levine

[57] ABSTRACT

A simulated structural gasket for supporting a panel, such as a glass window panel, within an opening defined by a window frame. The simulated gasket includes two elongated members which may be extruded aluminum, extending along and engaging opposite sides of a building frame flange which surrounds the window opening. The elongated members project beyond the frame flange into the opening and accommodate on edge of the glass window panel between them. A cross-member projects from one elongated member toward the other and overlies the frame flange. The cross-member and other elongated member are interlocked to prevent movement of the elongated members away from each other. A layer of resilient, rubber-like, material covers the outer surface of each elongated member and has a gasket portion located between its respective elongated member and the glass panel.

10 Claims, 9 Drawing Figures

SIMULATED STRUCTURAL GASKET

Figure 2:
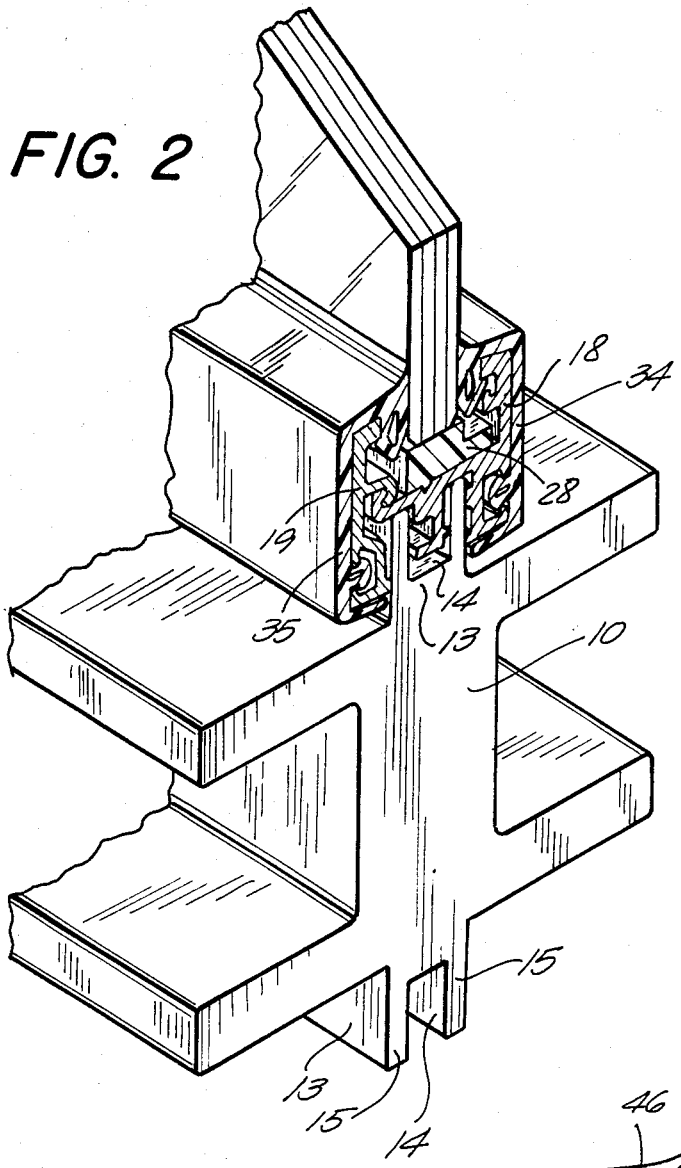

This invention relates to structural gaskets for architectural use, and especially to high performance gaskets of this type.

Elastomeric structural gaskets, also referred to as lockstrip gaskets, are described in detail in a publication entitled "Aluminum Curtain Walls", Issue 4, published by the Architectural Aluminun Manufacturers Association, of Chicago, Illinois, in December 1971. These gaskets are used, instead of other types of glazing, to support fixed panels, usually glass windows, within the framework of a building. The gaskets are made of an elastomer, typically neoprene or butyl.

Each gasket is formed with a longitudinal slot for accommodating a flange projecting from the building frame, the flange surrounding the opening in the wall to be closed by the fixed panel. In some cases the gasket is formed with a longitudinal rib which fits into a groove in the building frame. The gasket also has another slot for accommodating the edge of the glass window panel. An outer surface of the gasket presents a longitudinal slot, and after the gasket is in place in the building frame and the panel is in place in the gasket, a locking strip is forced into the slot in the outer surface of the gasket to tightly squeeze the gasket against both the frame and the panel.

Structural or lockstrip gaskets of this type perform well under ordinary conditions. However, under conditions where high performance is required, such as when large panels of glass are used and wind loads on those panels are high, these gaskets, because they are made of resilient material, have a tendency to "roll off" the frame flange on which they are mounted, i.e., they flex to such a degree that they actually slip off the flange. To prevent this undesirable effect, it is usually necessary to either use heavier specially designed and more expensive gaskets, or reinforce the gaskets with metal clips fixed to the building frame and located alongside one or both sides of the gasket. Such clips often interfere with the esthetic effect of the elastomeric glazing gaskets.

It is an object of the present invention to provide a simulated structural gasket which maintains the desirable appearance of an elastomeric glazing gasket, but which serves admirably under high performance conditions.

It is another object of the invention to provide a simulated structural gasket requiring no additional clips external to the gasket for reinforcement under high performance conditions.

It is a further object of the invention to provide a simulated structural gasket which is economically practical to both manufacture and install.

Additional objects and features of the invention will be apparent from the following description in which reference is made to the accompanying drawings.

IN THE DRAWINGS

Figure 1:
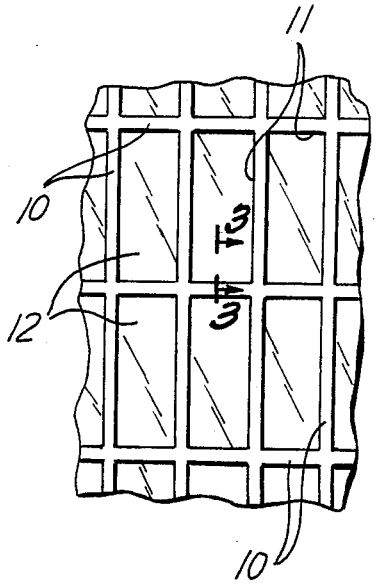
Figure 3:
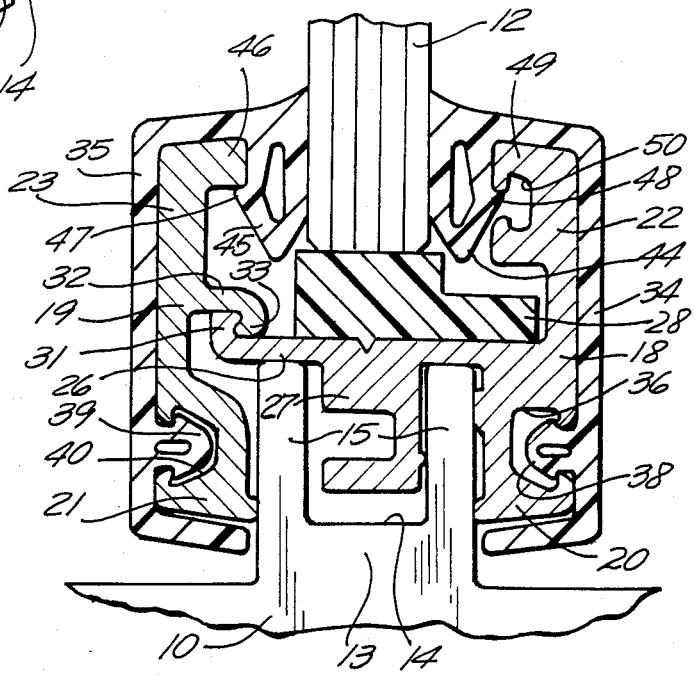

FIG. 1 is a fragmentary elevational view of the curtain wall of a building, showing a number of fixed glass panels supported by the building frame, FIG. 2 is a fragmentary perspective view, on an enlarged scale, of a portion of the curtain wall, FIG. 3 is a cross-sectional view, on still a larger scale, taken along line 3—3 of FIG. 1, and FIGS. 4–9 are views similar to FIG. 3, but on a smaller scale, showing a sequence of steps for installing a simulated structural gasket according to this invention.

The invention will be described in connection with an aluminum and glass curtain wall, but it is to be understood that it has utility in other environments as well. The curtain wall portion shown in FIG. 1 includes an aluminum framework formed by a grid of horizontal and vertical mullions 10 defining openings 11 filled by glass panels on panes 12.

As illustrated in FIG. 2, each mullion 10 may have the general shape of an I-beam. Projecting from each face of the mullion, and extending longitudinally along the mullion, is a flange 13 (see also FIG. 3). Thus, it will be appreciated that flanges 13 projecting from the mullions in FIG. 1 completely surround each opening 11. Each flange 13 may be formed with a longitudinal slot 14 defining two parallel upstanding walls 15 of the flange.

The simulated structural gasket of this invention serves, as does a conventional elastomeric structural gasket, as a connection between flange 13 and an edge of glass panel 12 to firmly support the panel within an opening 11 of the building frame. The simulated structural gasket includes a first elongated member 18 and a second elongated member 19 (see FIGS. 2 and 3), each of which is preferably an extrusion of a suitable metal, e.g., aluminum. Elongated members 18 and 19 extend parallel to the flange 13 with which they are used. Member 18 has a flange-engaging portion 20 and member 19 has a flange-engaging portion 21, the portions 20 and 21 engaging opposite sides of flange 13.

Elongated member 18 has a panel-supporting portion 22 and elongated member 19 has a panel-supporting portion 23. The panel-supporting portions 22 and 23 extend beyond the free edge of flange 13 into the opening 11. A cross-member 26 (FIGS. 3 and 4) projects laterally from the first elongated member 18 toward the second elongated member 19, the cross-member preferably being integrally formed as one piece with the member 18. Cross-member 26 overlies and rests upon flange 13, and a rib 27 extends from the cross-member into the slot 14 in rib 13. Thus, portion 20 of member 18, rib 27, and the part of cross-member 26 between portion 20 and rib 27 straddle one of the walls 15 of flange 13. Setting strips 28 (only one being seen in FIG. 3), are spaced apart along the length of cross-member 26, and are engaged by the edge of glass panel 12. The setting strips, which are of an elastomeric material and usually between one and two feet long, help to support the glass panel.

The free edge of cross-member 26 is formed, preferably along its entire length, with a lip 31 which preferably is slightly reversely turned to give it a moderate hook shape. An arm 32 projects form, and extends along the length of, elongated member 19. The free edge of arm 32 is formed, preferably along its entire length, with a lip 33 which preferably is slightly reversely turned to give it a moderate hook shape. Lips 31 and 33 are interlocked, as shown in FIG. 3, to prevent members 18 and 19 from moving away from each other.

An elongated layer of resilient material 34 overlies the outer surface of member 18, and a similar layer of resilient material 35 overlies the outer surface of member 19. Layers 34 and 35 are preferably formed of an elastomeric material, such as neoprene. Member 18 has a longitudinal slot 36 in its outer surface (see FIGS. 3 and 4), the mouth 37 of the slot having a smaller width than the interior portion of the slot. A resilient locking rib 38, formed integrally with layer 34 and having an arrowhead-like cross-sectional shape, is engaged within slot 36 to help retain layer 35 on member 18. A similar locking rib 39, carried by layer 35, fits into a longitudinal slot 40 in the outer surface of member 19, slot 40 having a narrowed mouth 41 (see FIG. 7). Preferably, slots 36 and 40, and locking ribs 38 and 39, extend for the full lengths of their respective elongated members 18 and 19.

Figure 4:
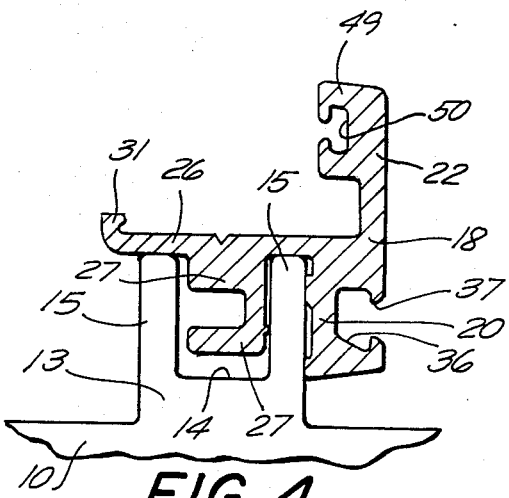
Figure 7:
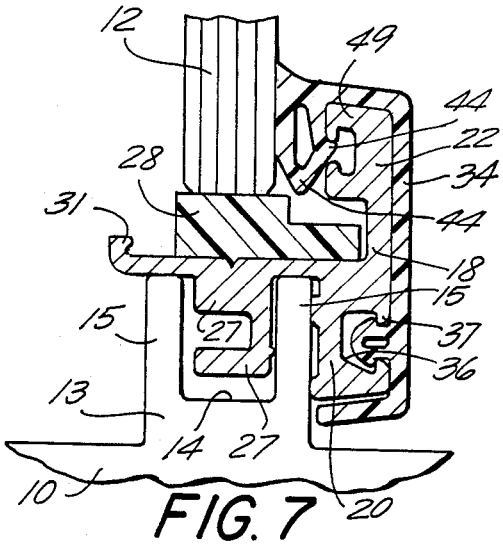

One longitudinal edge of layer 34 is formed with an integral gasket portion 44 squeezed between glass panel 12 and panel-supporting portion 22 of member 18. Similarly, one longitudinal edge of layer 35 is formed with an integral gasket 45 squeezed between glass panel 12 and panel-supporting portion 23 of member 19. Panel-supporting portion 23 is provided with a flange 46 turned toward glass panel 12 and gasket 45 is formed with a lip 47 which snaps around flange 46 to help hold the gasket in place. In a similar fashion, gasket 44 has a lip 48 which snaps around a flange 49 to help hold the gasket in place. If desired, flange 49 can be thickened, as shown in FIGS. 3 and 4, and provided with a longitudinal slot 50 having a narrowed mouth. Slot 50 can then accommodate an arrowhead shaped locking rib (not shown), comparable to rib 38 or 39, carried by gasket 44 to increase the strength of the interlocked engagement between gasket 44 and portion 22 of member 18.

Figure 5:
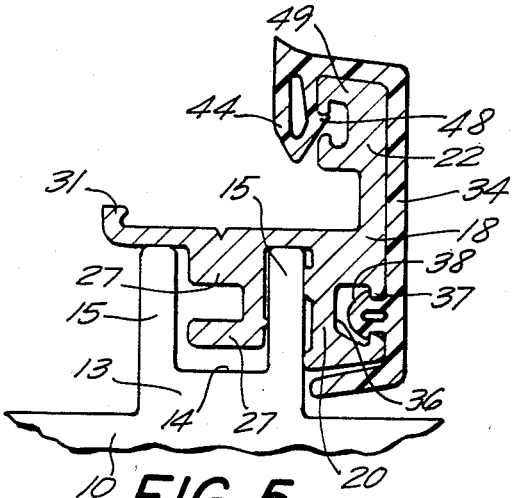

A manner in which the simulated structural gasket of the present invention may be assembled is illustrated in FIGS. 4 through 9. As shown in FIG. 4, the first elongated member 18 is placed on flange 13 of a mullion 10, flange-engaging portion 20 contacting the outer surface of one wall 15 of the flange, and rib 27 fitting into slot 14 and contacting the inner surface of the same wall 15. Thus, wall 15 fits snugly between rib 27 and portion 20. Cross-member 26 rests upon the free edges of walls 15 of flange 13. Next, as shown in FIG. 5, cover layer 34 is fitted over the outer surface of member 18 and locking rib 38 pressed into slot 36 through mouth 37, the resilience of the rib permitting this movement and the rib expanding into the slot after it passes through the mouth. Lip 48 is snapped under flange 49. Due to the effect of rib 39 and lip 48, cover layer 34 is held securely on member 18.

Figure 8:
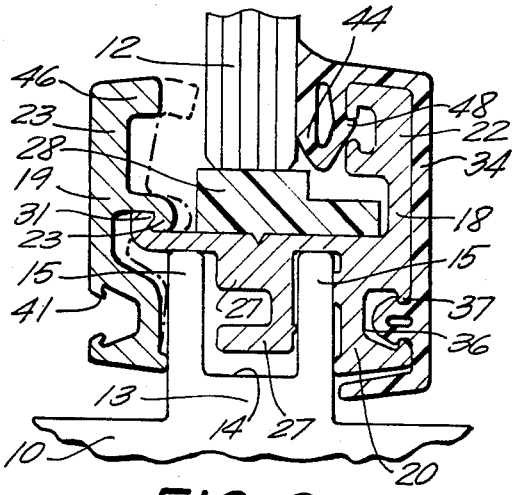
Figure 6:
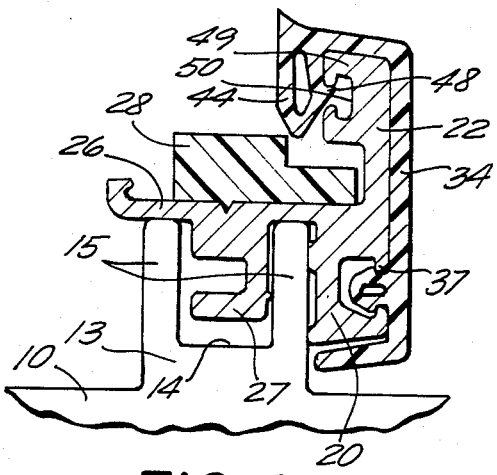
Figure 9:
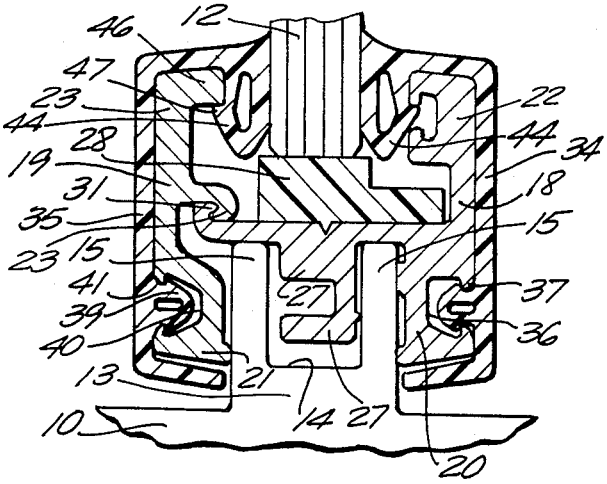

Setting strips 28 are then placed on cross-member 26, as shown in FIG. 6. A glass panel 12 (FIG. 7) is placed upon setting strips 28 and against gasket 44. Thereafter, as shown in FIG. 8, second elongated member 19 is assembled with member 18. To accomplish this, member 18 is first held in a tilted position, indicated by broken lines in FIG. 8, with flange-engaging portion 21 contacting an outer surface of flange 13. Member 19 is then swung to an upright position, shown in solid lines in FIG. 8, to interlock lips 31 and 33. In this position, member 19 is pivotable about an axis defined by the interengaged surfaces of lips 31 and 33. Finally, as shown in FIG. 9, cover layer 35 is fitted over the outer surface of member 19 and locking rib 39 is pressed into slot 40 through slot mouth 41. Gasket portion 45 is forced into the space between glass panel 12 and flange 46 of panel-supporting portion 23, lip 47 snapping under flange 46. The resilient pressure produced by gasket 45 tends to rotate member 19 about the axis defined by interlocked lips 31 and 33 and thereby press portion 21 of member 19 against flange 13. Thus, a very tight fit of gasket 45 between panel 12 and flange 46 is assured.

It will be appreciated that the present invention provides a rigid metal skeleton, in the form of members 18 and 19, which supports resilient gaskets 44 and 45 and setting strips 28 serving to tightly grip an edge of panel 12. In addition, the layers 34 and 35 covering the members 18 and 19 give the simulated structural gasket the desirable appearance of a conventional elastomeric structural or lockstrip gasket.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A simulated structural gasket for supporting a panel within an opening defined by a building frame, the frame having a flange surrounding the opening, the simulated gasket comprising:

first and second elongated metal members each having a flange-engaging portion extending along the length of the building frame flange, said portions engaging opposite sides of the flange, each of the elongated members having a panel-supporting portion extending beyond the free edge of the flange into the opening surrounded by the flange, an edge of the panel within the opening being located between the panel-supporting portions of the elongated members, a cross-member projecting laterally from the first elongated member toward the second elongated member, the cross-member overlying the building frame flange, cooperable locking means carried by the second elongated member and the cross-member for preventing movement of the elongated members away from each other, and a layer of resilient material covering the outer surface of each elongated member, each resilient layer having a gasket portion located between the panel-supporting portion of its respective elongated member and the panel being supported.

2. A simulated structural gasket as defined in claim 1 wherein each of said elongated members is an aluminum extrusion.

3. A simulated strucural gasket as defined in claim 2 wherein the first elongated member and the cross-member are formed integrally as a single piece.

4. A simulated structural gasket as defined in claim 1 wherein the resilient layer is formed of a material having the characteristics of rubber.

5. A simulated structural gasket as defined in claim 1 wherein the building frame flange has a longitudinal slot which is open toward the opening defined by the building frame, the cross-member carrying a rib which extends into the slot.

6. A simulated structural gasket as defined in claim 1 wherein the cooperable locking means includes a lip extending along and projecting from the cross-member, and an arm extending along the second elongated member, the arm having a lip directed toward the cross-member, the cross-member lip and the arm lip being interlocked.

7. A simulated structural gasket as defined in claim 6 wherein each of the cross-member lip and the arm lip has a hook-like formation when viewed in cross-section, each hook-like formation being engaged within the other.

8. A simulated structural gasket as defined in claim 1 wherein the second elongated member is rotatable about an axis defined by the cooperable locking means, and the resilience of the gasket portion located between the panel and the panel-supporting portion of the second elongated member tends to rotate the second elongated member so as to press its flange-engaging portion against the building frame flange.

9. A simulated structural gasket as defined in claim 1 wherein each of the elongated members has a longitudinal slot in its outer surface, and each resilient covering layer has an integrally formed resilient locking rib frictionally engaged within the slot of the respective elongated member.

10. A simulated structural gasket as defined in claim 1 wherein each panel-supporting portion of the elongated members has a flange projecting toward the other panel-supporting portion, and each gasket portion of the resilient cover layers is formed with a lip which snaps under its respective panel-supporting flange.

* * * * *